US008777352B2

(12) United States Patent
Sakai

(10) Patent No.: US 8,777,352 B2
(45) Date of Patent: Jul. 15, 2014

(54) PRINTING DEVICE, PRINTING METHOD, AND MEDIUM HAVING RECORDED PROGRAM

(75) Inventor: Hirofumi Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

(21) Appl. No.: 13/482,519

(22) Filed: May 29, 2012

(65) Prior Publication Data

US 2012/0313990 A1 Dec. 13, 2012

(30) Foreign Application Priority Data

Jun. 7, 2011 (JP) ..... 2011-126845

(51) Int. Cl.

| | |
|---|---|
| ***B41J 29/38*** | (2006.01) |
| ***B41J 19/14*** | (2006.01) |
| ***B41J 2/145*** | (2006.01) |
| *B41J 2/21* | (2006.01) |

(52) U.S. Cl.

CPC ..... *B41J 19/142* (2013.01); *B41J 2/145* (2013.01); *B41J 2/2132* (2013.01)

USPC ..... 347/12

(58) Field of Classification Search

CPC ..... B41J 2/145; B41J 2/2132; B41J 19/142

USPC ..... 347/9, 12, 16, 40

See application file for complete search history.

(56) References Cited

U.S. PATENT DOCUMENTS

| | | | | |
|---|---|---|---|---|
| 7,682,015 | B2 * | 3/2010 | Hoshino | 347/102 |
| 8,547,597 | B2 * | 10/2013 | Ogawa | 358/3.06 |
| 8,570,592 | B2 * | 10/2013 | Yoshida | 358/1.9 |
| 2007/0188547 | A1 | 8/2007 | Kobayashi et al. | |
| 2010/0134811 | A1 | 6/2010 | Fukasawa et al. | |
| 2010/0177131 | A1 | 7/2010 | Yoshida | |

FOREIGN PATENT DOCUMENTS

| | | | |
|---|---|---|---|
| JP | 2004-098017 | A | 4/2004 |
| JP | 2007-050555 | A | 3/2007 |
| JP | 2010-076216 | A | 4/2010 |
| JP | 2010-130405 | A | 6/2010 |
| JP | 2010-166152 | A | 7/2010 |
| JP | 2011-079273 | A | 4/2011 |
| JP | 2011-183674 | A | 9/2011 |

* cited by examiner

*Primary Examiner* — An Do

(74) *Attorney, Agent, or Firm* — Global IP Counselors, LLP

(57) ABSTRACT

To provide technology that can reduce the possibility of an image becoming blurry with a printing device for printing images on a printing medium. A printing device is equipped with an affixing part for affixing on a printing medium ink containing a special glossy ink having reflectance angle dependence as an optical characteristic, and a controller for controlling the operation of the printing device. The controller uses the affixing part to form a base layer by affixing the special glossy ink on the printing medium, and after the base layer is formed, forms an image layer representing an image by affixing on the base layer special glossy ink and, among the inks noted above, ink other than the special glossy ink.

10 Claims, 14 Drawing Sheets

SECOND PRINTING MODE

PRINTING DEVICE, PRINTING METHOD, AND MEDIUM HAVING RECORDED PROGRAM

CROSS-REFERENCE TO RELATED APPLICATIONS

This application claims priority to Japanese Patent Application No. 2011-126845 filed on Jun. 7, 2011. The entire disclosure of Japanese Patent Application No. 2011-126845 is hereby incorporated herein by reference.

BACKGROUND

1. Technical Field

The present invention relates to a technology for printing on a printing medium using ink containing a special glossy ink having a texture such as a glossy appearance.

2. Background Technology

With printers that are used as printing devices, a printer which is the printing device performs printing by affixing ink to a printing medium. Technology is known with which a base layer is formed on a printing medium, and an image layer representing an image is formed on the base layer (e.g. Patent Documents 1 and 2). With the technology in Patent Document 1, white ink is used to form the base layer, and colored inks such as black, magenta, cyan, yellow and the like are used to form the image layer.

Japanese Laid-open Patent Publication No. 2007-50555 (Patent Document 1) and Japanese Laid-open Patent Publication No. 2010-166152 (Patent Document 2) are examples of the related art.

SUMMARY

Problems to Be Solved by the Invention

Here, the ink jet head (also simply referred to as "head") disclosed in Patent Document 1 is for example provided with nozzles that discharge white ink upstream and with nozzles that discharge colored ink downstream in relation to the sub-scan direction which is the printing medium transport direction.

In some cases, the special glossy ink is used to form not only the base layer but also the image layer. In this case, the image layer is formed by having the special glossy ink's ink volume be greater in a field for which the base layer and image layer overlap than with a base layer-only field. As with the technology in Patent Document 1, when the nozzles that discharge the white ink to form the base layer and the nozzles that discharge the colored ink are arranged displaced without overlapping in the sub-scan direction, the following kinds of problems arise. Specifically, of the images printed on the printing medium, for fields on which images are formed using ink containing special glossy ink ("glossy image fields"), by forming the base layer while simultaneously making the ink volume of the special glossy ink greater than for other fields, a glossy image field image is formed. However, in this case, on the glossy image field, because the image layer is formed before the base layer is dried and fixed, there are cases when the special glossy ink of the glossy image field flows, and the image (pattern) on the printing medium is blurred.

Therefore, an advantage of the invention is to provide technology for which with a printing device for printing an image on a printing medium, it is possible to reduce the possibility of the image being blurred when special glossy ink is formed as a base layer, and an image layer representing the image is formed using an ink containing special glossy ink on the top part of the base layer.

Means Used to Solve the Above-Mentioned Problems

The invention was developed in order to resolve at least some of the above problems and can be worked in the form of the following modes and application examples.

Application Example 1

A printing device for printing an image on a printing medium, including an affixing part for affixing on a printing medium ink containing special glossy ink whose optical characteristics depend on the reflection angle, and a controller for controlling the operation of the printing device, wherein the controller forms the base layer by affixing the special glossy ink on the printing medium using the affixing part, and after forming the base layer, forms the image layer representing the image by affixing on the base layer the special glossy ink as well as, among the inks, inks other than the special glossy ink.

In accordance with the printing device described in Application Example 1, after the base layer is formed using the special glossy ink, the image layer is formed using ink containing special glossy ink. Thus, it is possible to form the image layer on the base layer after fixing on the printing medium is accelerated with drying progress. Thus, it is possible to inhibit the flow of ink affixed on the base layer due to formation of the image layer, making it possible to reduce the possibility of blurring of the image formed on the printing medium.

Application Example 2

The printing device according to Application example 1, wherein the affixing part is a nozzle group that moves in the primary scan direction, and that discharges the ink toward the printing medium, and is a nozzle group for which unit nozzle groups which are collections of nozzles arranged aligned in the sub-scan direction formed for each ink color are aligned in the primary scan direction, wherein the nozzle group includes an upstream nozzle group arranged upstream in the sub-scan direction and that discharges the special glossy ink, and a downstream nozzle group arranged downstream in the sub-scan direction and that discharges the ink containing the special glossy ink.

In accordance with the printing device of Application Example 2, there is an upstream nozzle group arranged upstream and a downstream nozzle group arranged further downstream than the upstream nozzle group. Thus, it is possible to form the image layer using the downstream nozzle group after forming the base layer using the upstream nozzle group while transporting the printing medium from upstream to downstream. Thus, it is possible to reduce the possibility of the image formed on the printing medium being blurred while simplifying control during printing.

Application Example 3

The printing device according to Application Example 1 or Application Example 2, wherein the ink further includes colored ink for forming the image layer.

In accordance with the printing device of Application Example 3, since the ink contains colored ink, it is possible to express various color hues.

Application Example 4

The printing device according to Application Example 3 which is dependent on Application Example 2, wherein the printing device can perform printing using either a first printing mode which forms the image layer using the special glossy ink on the base layer after forming the base layer using the special glossy ink, or a second printing mode which forms the image layer using the ink on the printing medium without forming the base layer, wherein the controller has the base layer formed using the upstream nozzle group, and has the image layer formed using the downstream nozzle group with the first printing mode, and has the image layer formed using a nozzle group including the upstream nozzle group and the downstream nozzle group with the second printing mode.

In accordance with the printing device of Application Example 4, the controller divides use of the nozzles corresponding to two modes with different printing methods. Thus, it is possible to perform optimal printing with each mode. Specifically, with the first mode, it is possible to reduce the possibility of the image layer becoming blurred by the image layer being formed after the base layer. With the second mode, it is possible to use the nozzles efficiently since the image layer is formed using the upstream nozzle group and the downstream nozzle group, making it possible to increase the printing speed.

Application Example 5

The printing device according to any of Application Examples 1 to 4, wherein the special glossy ink is metallic ink.

In accordance with the printing device of Application Example 5, it is possible to give the printing medium a metallic glossy appearance.

Application Example 6

The printing device according to any of Application Examples 1 to 5, further including a drying mechanism for drying the base layer formed on the printing medium.

In accordance with the printing device of Application Example 6, by providing a drying mechanism, drying of the base layer can be accelerated. By doing this, it is possible to further inhibit flowing of the ink of the image layer formed on the base layer, making it possible to further reduce the possibility of blurring of the image formed on the printing medium.

Application Example 7

The printing device according to any of Application Examples 1 to 6, wherein in the field on which are formed the base layer by the special glossy ink and the image layer by the special glossy ink and inks other than the special glossy ink, the time T1 between affixing of the special glossy ink for forming the base layer and affixing of the special glossy ink for forming the image layer is longer than the time T2 between affixing of the special glossy ink for forming the image layer and affixing of the inks other than the special glossy ink for forming the image layer.

In accordance with the printing device of Application Example 7, by making the time T1 longer than the time T2, compared to when the time T1 and the time T2 are the same, it is possible to accelerate the drying of the special glossy ink affixed for forming the base layer. As a result, it is possible to reduce the possibility of blurring of the image formed on the base layer.

Application Example 8

The printing device according to any of Application Examples 1 to 7, wherein on a printing medium for which the base layer formation is not performed, in the field on which the image layer is formed by the special glossy ink and inks other than the special glossy ink, the time T3 between affixing of the special glossy ink for forming the image layer and affixing of inks other than the special glossy ink for forming the image layer is longer than, on a printing medium for which the base layer formation is performed, in the field on which the image layer is formed by the special glossy ink and inks other than the special glossy ink, the time T4 between affixing of the special glossy ink for forming the image layer and affixing of inks other than the special glossy ink to form the image layer.

In accordance with the printing device of Application Example 8, by making the time T3 longer than the time T4, when forming the image layer on the printing medium for which the base layer formation is not performed, it is possible to accelerate the drying of the special glossy ink. As a result, it is possible to inhibit the flow of the special glossy ink, making it possible to reduce the possibility of blurring of images formed on the printing medium.

The invention can be embodied in a variety of configurations. In addition to the printing device described above, the invention can be embodied in modes such as a printing medium, a computer program for forming images using the printing device, and a printing medium on which that program is recorded.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the invention are described in the following sequence:

A. First embodiment:

B. Second embodiment:

C. Modification examples:

A. First Embodiment

A-1. System Configuration

Figure 1:
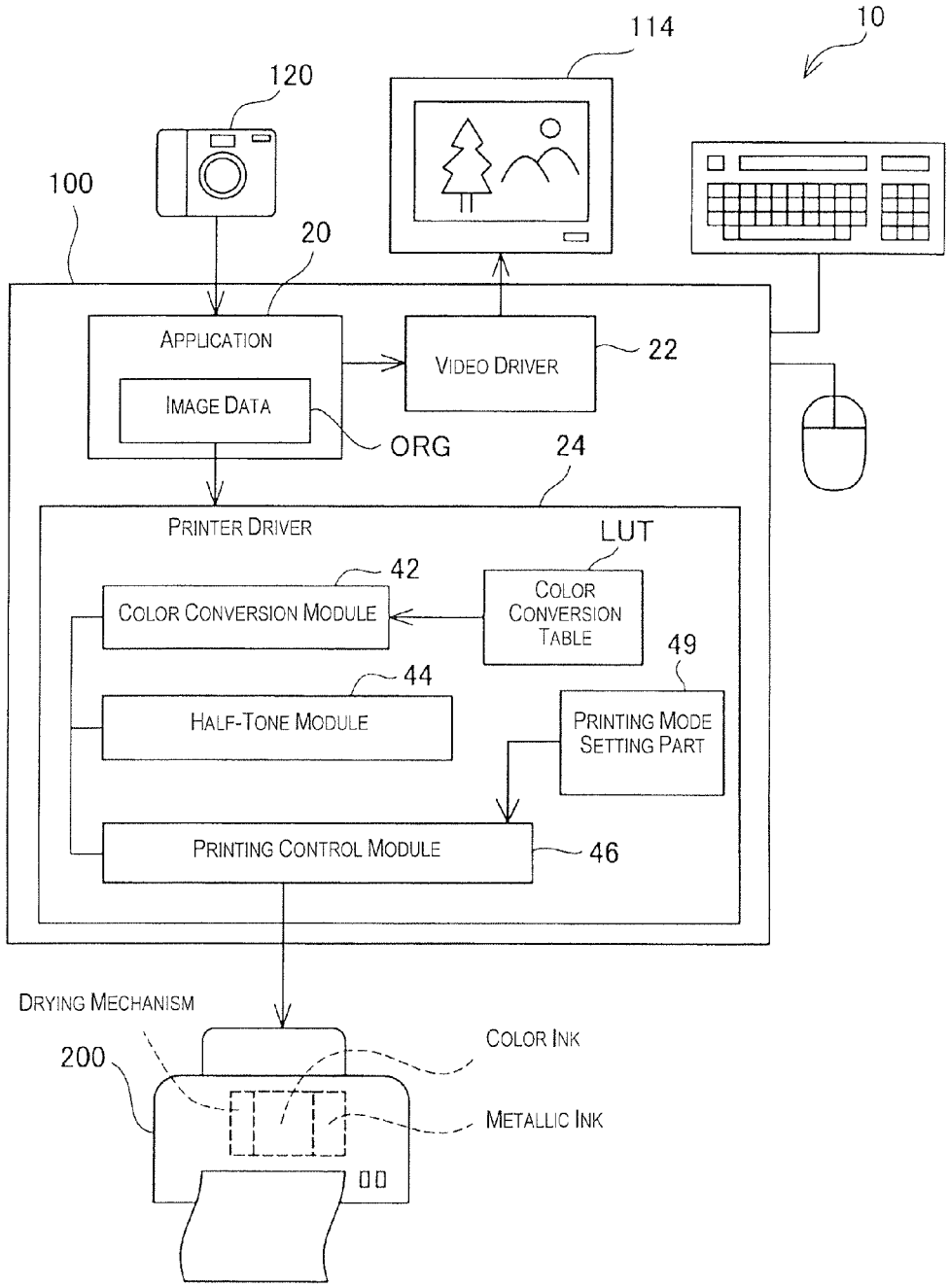
FIG. 1 is a schematic configuration diagram of the printing system 10 in a first embodiment of the invention.

FIG. 1 is a schematic configuration diagram of the printing system 10 in a first embodiment of the invention. The printing system 10 of this embodiment includes a computer 100 used as a printing control device, and a printer 200 that is controlled by the computer 100 and prints an image on a printing medium. The printing system 10, taken as an integral whole, functions as a printing device broadly defined.

The printer 200 has colored ink, and a metallic ink that is a special glossy ink. The colored ink is used to form an image on a printing medium. More specifically, it is used to affix a color hue on the printing medium. Specifically, the colored ink is ink required for printing color images and monotone images. With this embodiment, cyan ink, magenta ink, yellow ink, and black ink are used as colored inks. Any of the colored inks can be a pigment-based ink.

The special glossy ink is used in order to provide the printing medium with a glossy appearance and light-shielding properties, and is also used to form images. Specifically, the special glossy ink is used to form both the base layer and the image layer. For example, when printing an image on a light-transmissive printing medium, with the goal of printing a clear image, a base layer having light-shielding properties is formed on the field of the light-transmissive printing medium on which the image is formed. Also, special glossy ink is used to form an image layer representing an image containing patterns or textures such as a specific pattern. By using the special glossy ink for the image layer, it is possible to have the image exhibit a special glossy appearance such as a metallic appearance.

The special glossy ink is a texture-exhibiting ink that contains a pigment that exhibits a specific texture. With this embodiment, a metallic ink containing metal pigment that expresses a metallic appearance (e.g., metal foil) is used as the special glossy ink. The metal pigment, for example, can be formed from aluminum or aluminum alloy and can be produced by grinding metal vapor-deposited film. Other suitable components can be used as the metal pigment in the metallic ink, provided that the composition produces a metallic gloss. Also, the special glossy ink such as a metallic ink has light-shielding properties.

Metallic ink is an ink for which the printed material exhibits a metallic appearance, and for example, oil-based ink compositions containing metal pigment, organic solvent, and resin can be used as this kind of metallic ink. To effectively generate a metallic sense visually, the previously described metal pigment is preferably in the form of plane shaped particles, and when the long diameter is X, the short diameter is Y, and the thickness is Z on the plane of this plan shaped particle, it is preferable to satisfy the conditions of the 50% average particle diameter R50 of the equivalent circle diameter found from the area of the X-Y surface of the plane shaped particle being 0.5 to 3 μm, and R50/Z being greater than 5. The metal pigment, for example, can be formed from aluminum or aluminum alloy and can be produced by grinding metal vapor-deposited film. The concentration of the metal pigment contained in the metallic ink can be 0.1 to 10.0 weight %, for example. Of course, the metallic ink is not limited to this kind of composition, and other suitable compositions can be used as long as the composition produces a metallic appearance.

The composition of the metallic ink can also be aluminum pigment 1.5 weight %, glycerin 20 weight %, triethylene glycol monobutyl ether 40 weight %, and BYK-UV3500 (made by BYK Japan) 0.1 weight %.

Special glossy inks can also be described as inks whose optical characteristics depend on the reflection angle when printed on the surface of a printing medium. In other words, the appearance (e.g., reflectance, brightness) of the special glossy ink that is affixed to the printing medium surface is different depending on the viewing angle. Here, having reflection angle dependence (angle dependence) means that at least one of the spectral reflectivity and the spectral transmittance differs according to the angle.

A specified operating system is installed on the computer 100. An application program 20 is operated on this operating system. The operating system incorporates a video driver 22 and a printer driver 24. The application program 20, for example, inputs the image data ORG from the digital camera 120. When this occurs, the application program 20 displays the image represented by the image data ORG on a display 114 via the video driver 22. In addition, the application program 20 outputs image data ORG to the printer driver 24. The printer driver 24 then processes the input image data ORG by various methods described below, and the image data that has been processed (also referred to as "processed image data") is output to the printer 200.

In this embodiment, the image data ORG that is input from the digital camera 120 is data that is composed of three color components, red (R), green (G), and blue (B). The application program 20 adds metal ink data as necessary to the image data ORG that has been input from the digital camera 120. The metallic ink data has special gloss data for the base layer and special gloss data for the image layer. The base layer special gloss data is data for affixing the metallic ink for base layer formation on the printing medium. The image layer special gloss data is data for affixing metallic ink for image layer formation on the printing medium. Adding this metallic ink data can be carried out automatically by the application program 20 or in accordance with a command by the user. Of the data that is added to the image data ORG, the field for which the base layer is formed on the printing medium is also referred to as the "base layer field." Also, of the printing fields of the printing medium, the fields containing the R, G, B color components for forming the image layer are also referred to as the "image layer color production fields." The fields containing metallic ink for forming the image layer are also referred to as the "image layer metallic fields." The fields for which the image layer color production fields and the image layer metallic fields overlap are also referred to as "image layer overlapping fields." The fields on which the base layers are formed are also referred to as "base layer fields."

In this embodiment, the base layer field and the image layer color production field are automatically set by the application program 20. The base layer special gloss data is added to the image data ORG by the base layer field being set. The image layer metallic field can be set by the user specifying the field for which to have the metallic appearance exhibited among the image data ORG, for example. The image layer overlapping field can be automatically set by the application program 20 by having the image layer color production field and the image layer metallic field set. The image layer special gloss data is added to the image data ORG by having the image layer metallic field containing the image layer overlapping field set.

The printer driver 24 receives image data ORG from the application program 20 and converts the data to data that can be output to the printer 200. The printer driver 24 includes a color conversion module 42 for performing color conversion, a color conversion table LUT used for reference during color conversion, a half-tone module 44 for performing multiplexing subsequent to color conversion, a printing control module 46 for converting the multiplexed data into dot data for the respective colored inks, and a printing mode setting part 49 for setting the printing sequence mode.

The printing system 10 is equipped with first and second printing modes as the printing modes. The first printing mode is a mode for printing on a light-transmissive printing medium, and the second printing mode is a mode for printing on a non-light-transmissive printing medium. Specifically, the first printing mode is the mode for forming the image layer after the base layer is formed, and the second printing mode is the mode for forming the image layer without formation of the base layer. The first and second printing modes are described in detail later.

The color conversion module 42 acts on the processed image data and converts the respective color components R, G, and B in the image layer color production field containing the image layer overlapping field in the image data into color components that can be expressed by the printer 200 (cyan (C), magenta (M), yellow (Y), black (K)) in accordance with the color conversion table LUT. As a result, the data for the respective color components R, G, and B in the image layer color production field is converted into ink volumes per unit surface area (dot recording ratios) for each ink color the printer 200 is equipped with.

In this embodiment, the ink volume per unit surface area (dot recording ratio) of the metallic ink of the base layer field is set to 10%. The base layer field ink volume can be suitably set according to the type of special glossy ink used to form the base layer, or the type of printing medium on which the base layer is formed. The ink volume per unit surface area of the metallic ink used for the image layer formed on the base layer is set to 20%. Meanwhile, with the second printing mode with which the image layer is formed without the base layer being formed, the ink volume per unit surface area used for the image layer is set to 30%. This is because almost no increase in the metallic appearance is foreseen when the ink volume of the metallic ink exceeds 30%. The ink volume of the metallic ink for forming the image layer on the base layer is not limited to being 20%, and can also be set to values such as 5% or 10%. It is also possible to divide the ink volume of the metallic ink for forming the image layer into a plurality of levels (e.g. 5%, 15%, and 20%), so that the user can set the ink volume for each field as desired.

The half-tone module 44 carries out half-tone processing in which the gray scale of image data that has been subjected to color conversion by the color conversion module 42 is represented as a dot distribution. In addition, the half-tone module 44 performs half-tone processing according to the metallic ink volume stored as existing data within the printer driver 24 (e.g. with the first printing mode, ink volume 10% for the base layer, and ink volume 20% for the image layer). In this embodiment, the well-known ordered dithering method is used for half-tone processing. In addition to ordered dithering methods, error distribution methods, concentration pattern methods, and other half-tone technologies can be used for half-tone processing.

The printing control module 46 rearranges the dot arrangement in the generated dot data to produce an order that is to be relayed to the printer 200 and outputs the data to the printer 200 as printing data. In addition, the printing control module 46 outputs various commands such as a start command or print end command to the printer 200, thereby controlling the printer 200.

The printing mode setting part 49 receives user instructions concerning which printing mode to carry out from among the first and second printing modes prior to initiation of print processing, and sets the printing mode based on instructions that have been received.

A-2. Printing Modes

Figure 2A:
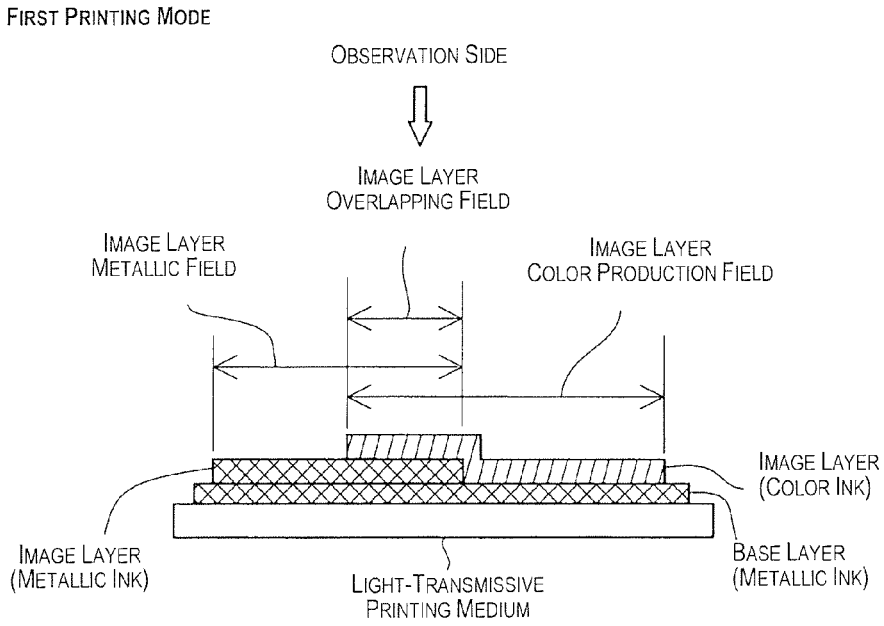
FIG. 2 is a diagram for illustrating the printing mode.
Figure 2B:
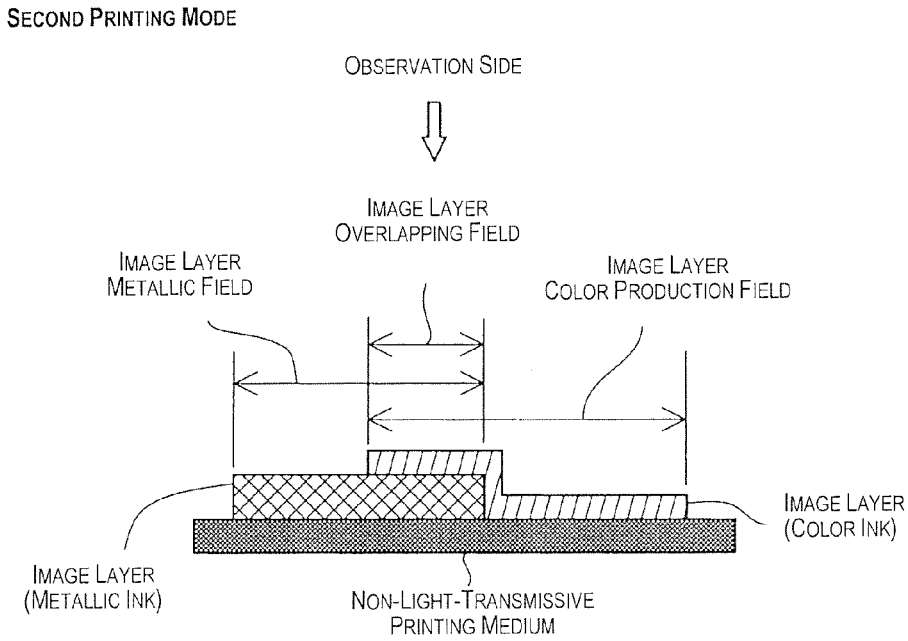

FIG. 2 is a diagram for illustrating the printing modes. FIG. 2A schematically presents a sectional view of the printing medium after printing has been carried out using the first printing mode. FIG. 2B schematically presents a sectional view of the printing medium after printing has been carried out using the second printing mode.

As shown in FIG. 2A, the first printing mode is a printing mode that utilizes a transparent printing medium having light-transmissive properties for the printing medium. With the first printing mode, the printed print image is viewed from the printed surface. With the first printing mode, first, in order to ensure light shielding properties, metallic ink is affixed to form a base layer on the light-transmissive printing medium. The base layer is formed at least on the bottom part of the field of the printing medium on which the image layer is formed. Next, the image layer is formed as the top layer. More specifically, metallic ink is affixed to the image layer metallic field, and subsequently colored inks (C, M, Y, and K) are affixed to the image layer color production field to form the image layer.

A shown in FIG. 2B, the second printing mode is a printing mode that uses a non-light-transmissive printing medium as the printing medium, for example a printing medium consisting of a paper medium or a non-light-transmissive plastic. Note that with the second printing mode, the printed print image is viewed from the printed surface. With the second printing mode, ink is affixed to the printing medium in the same sequence as with the first printing mode described above. The point of difference is that the image layer is formed directly on the printing medium without formation of a base layer. Specifically, with the second printing mode, on a non-light-transmissive printing medium, first, metallic ink is affixed to the image layer metallic field, and next, colored ink is affixed to the image layer color production field, thus forming the image layer.

Figure 3:
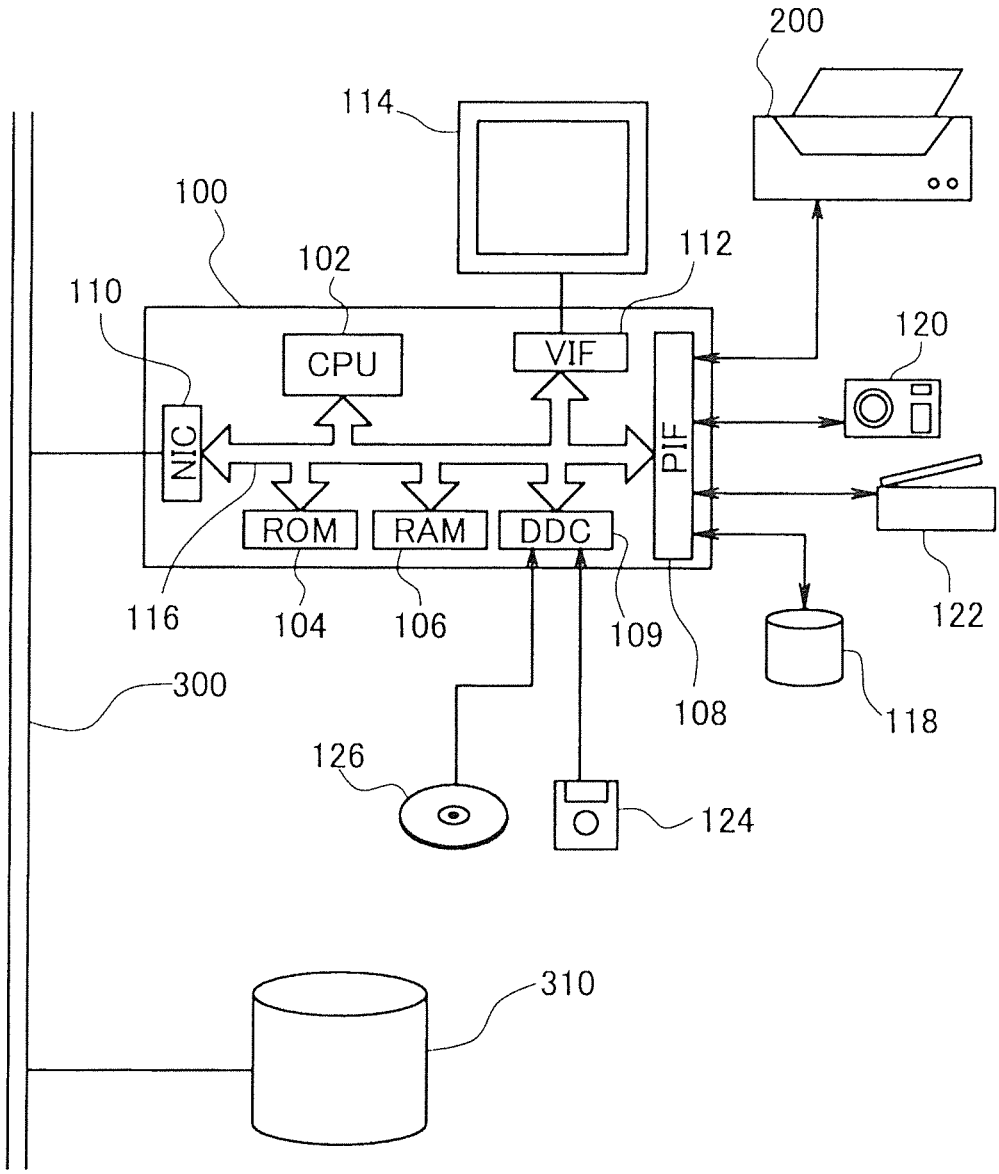
FIG. 3 is a schematic configuration diagram of the computer 100.

A-3. Specific Configurations of the Printing Control Device and Printing Device FIG. 3 is a schematic configuration diagram of the computer 100. The computer 100 has a well-known configuration in which ROM 104, RAM 106, and the like are connected to each other via a bus 116 with a CPU 102 at the core.

A disk controller 109 for reading data from a floppy disk 124, compact disk 126, or the like, a peripheral device interface 108 for sending and receiving data with respect to peripheral devices, and a video interface 112 for driving the display 114, are connected to the computer 100. The printer 200 and the hard disk 118 are connected to the peripheral device interface 108. In addition, if a digital camera 120 or color scanner 122 is connected to the peripheral device interface 108, then it will be possible to carry out image processing on images that have been captured by the digital camera 120 or the color scanner 122. In addition, if a network interface card 110 is mounted, then data that has been recorded on a storage device 310 that is connected by a communication line can be acquired by connecting the computer 100 to a communication line 300. The computer 100 acquires image data that is to be printed, and then the printer 200 is controlled through operation of the printer driver 24 described above in order to print the image data.

Figure 4:
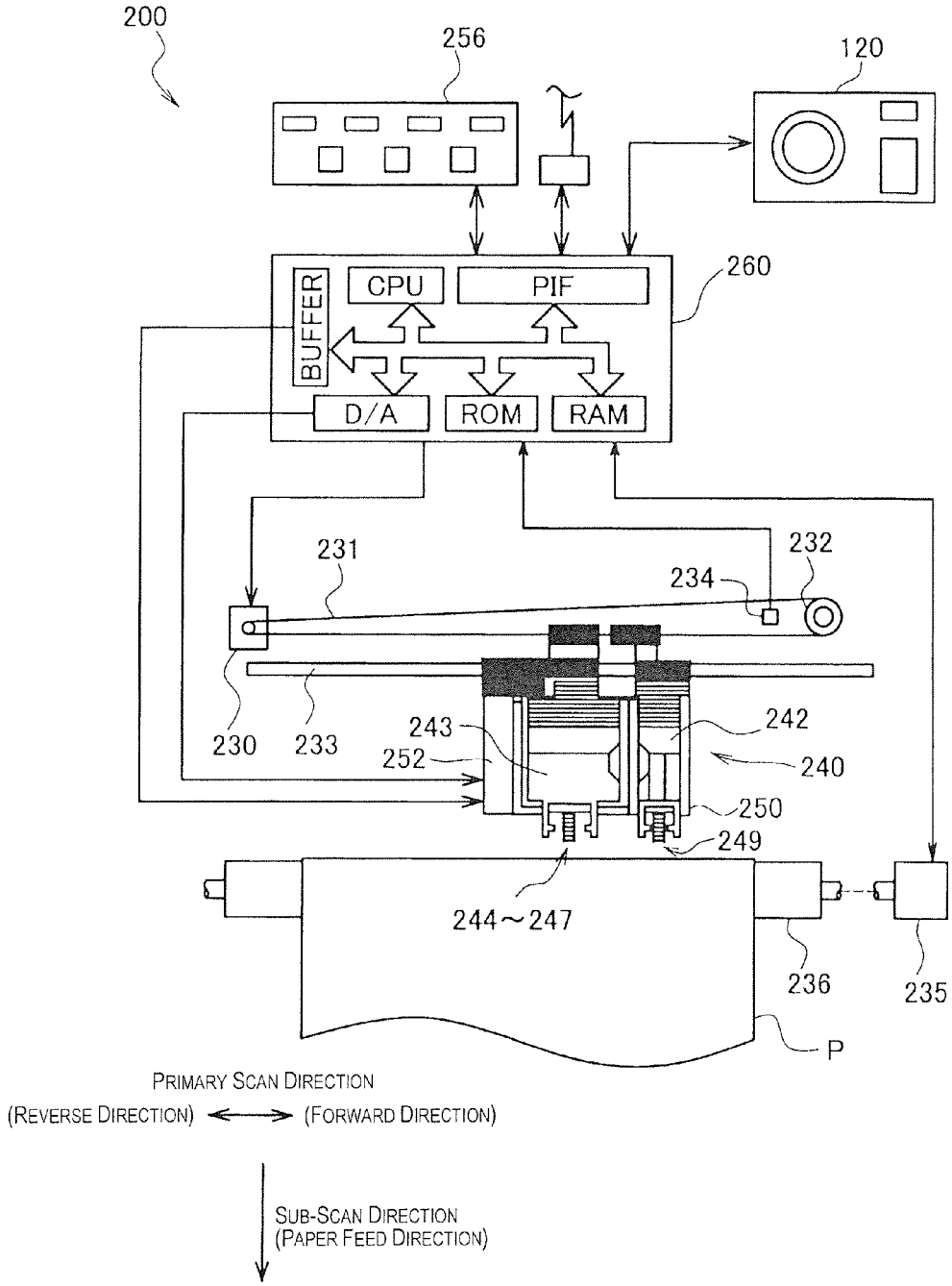
FIG. 4 is a block diagram showing the schematic configuration of the printer 200.

FIG. 4 is a block diagram showing the schematic configuration of the printer 200. As shown in FIG. 4, the printer 200 includes a mechanism for transporting a printing medium P by a paper feed motor 235, a mechanism for back and forth movement of a carriage 240 in the axial direction of the platen 236 by a carriage motor 230, a mechanism for discharging inks and forming dots by driving a printing head 250 that is mounted on the carriage 240 and is used as the affixing part, a drying mechanism 252, and a control circuit 260 that can send and receive signals with respect to the paper feed motor 235, the carriage motor 230, the printing head 250, the drying mechanism 252, and an operating panel 256. As noted above, the printer 200 of this embodiment is a serial printer.

The mechanism for moving the carriage 240 back and forth in the axial direction of the platen 236 comprises a sliding shaft 233 that is erected parallel to the axis of the platen 236 and slidably supports the carriage 240, a pulley 232 on which an endless drive belt 231 is suspended between [the pulley] and the carriage motor 230, and a position detection sensor 234 that detects the origin position of the carriage 240.

On the carriage 240 are mounted colored ink cartridges 243 that respectively house cyan ink, magenta ink, yellow ink, and black ink that are used as colored inks. On the carriage 240 is also mounted a metallic ink cartridge 242 for housing a metallic ink. A total of five rows of unit nozzle groups 244 to 249 corresponding to each of these colors are formed on the printing head 250 on a bottom part of the carriage 240. When the ink cartridges 242 and 243 are mounted from above on the carriage 240, ink can be supplied to the unit nozzle groups 244 to 249 from the respective cartridges.

The drying mechanism 252 is attached to the carriage 240, and this is equipped with a nozzle for blowing air on the printing medium P, and a heating part for heating the blown air (e.g. electrically heated wires). Using the drying mechanism 252, heated air is blown on the printing medium P, and drying of the inks affixed to the printing medium P from each nozzle of each unit nozzle group 244 to 249 is accelerated.

Figure 5:
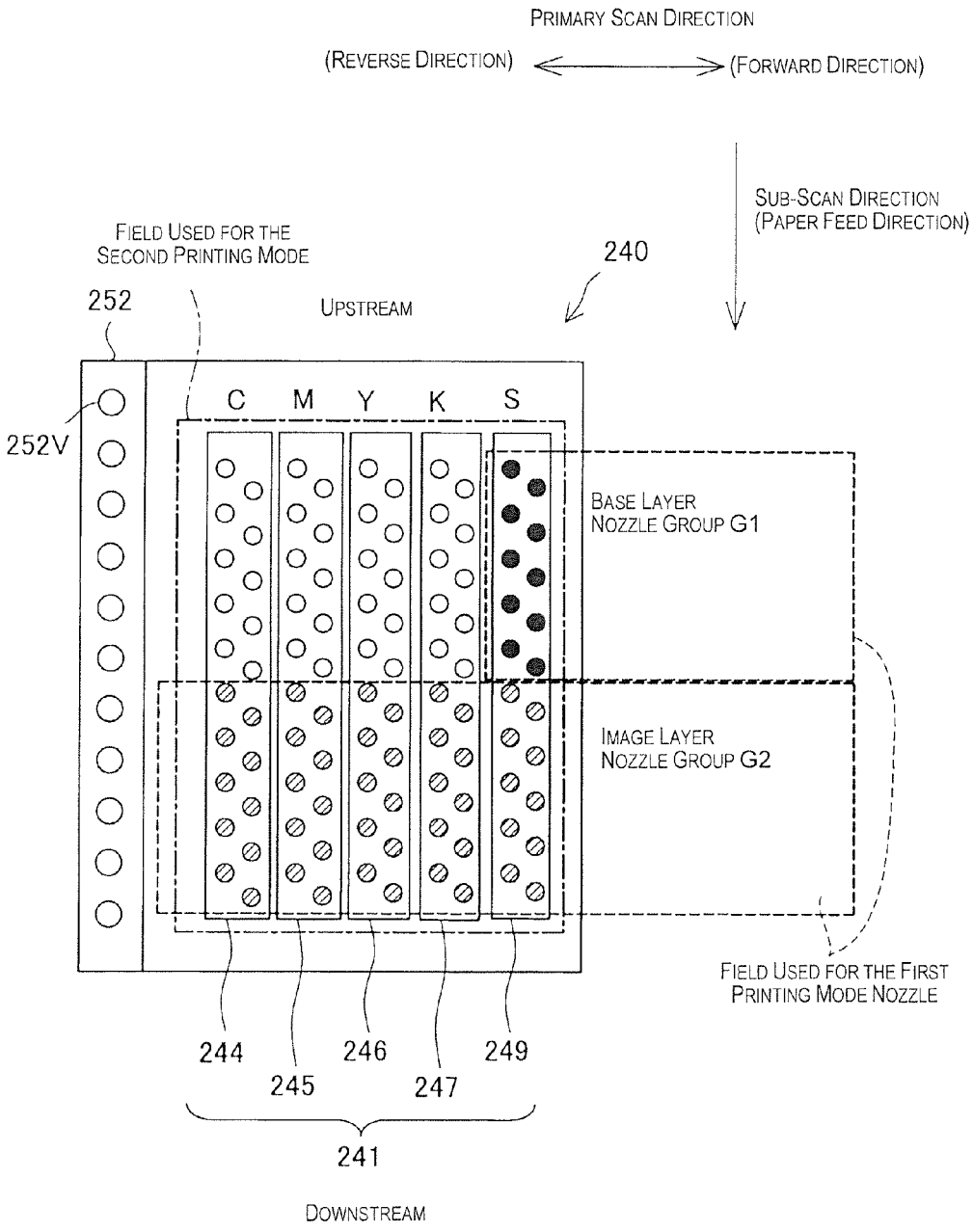
FIG. 5 is a schematic diagram of the carriage 240 and the drying mechanism 252.

The printing head 250 and the drying mechanism 252 will be described below. FIG. 5 is a schematic diagram of the surface (nozzle forming surface) facing opposite the printing medium P of the carriage 240 and the drying mechanism 252. Among the nozzles that discharge each color of ink, the nozzles that are nozzles positioned inside the field enclosed by dotted lines in FIG. 5, for which cross hatching and black color is implemented, are the nozzle groups used in the first printing mode. More specifically, the nozzle groups shown with cross hatching are used as the nozzle group G2 for the image layer for forming the image layer in the first printing mode, and the nozzle groups shown with a black circle are used as the nozzle group G1 for the base layer with the first printing mode.

96 nozzles are provided for the inks of each color metallic ink (S), cyan ink (C), magenta ink (M), yellow ink (Y), and black ink (K), but for purposes of illustration, twenty nozzles each are noted for each color in FIG. 5. Although each color is described as having twenty hereafter, the number of nozzles is set in accordance with the specifications of the printer 200. The unit nozzle groups 244 to 249 for discharging the ink of each color are arranged in the primary scan direction and form the nozzle group 241 of the printing head 250. The nozzles constituting each of the unit nozzle groups 244 to 249 are aligned along the sub-scan direction on the bottom surface of the printing head 250 and arranged in zigzag form (alternating). The bottom of the drawing shows the sub-scan direction (paper feed direction), so during printing, the printing medium P passes from the nozzle shown furthest to the top. Specifically, of the unit nozzle groups 244 to 249, the paper surface top side is upstream, and the paper surface bottom side is downstream.

When executing printing in the first printing mode, printing is performed in sequence on the printing medium P with ink affixed in the sequence of metallic ink for forming the base layer, metallic ink for forming the image layer, and colored ink for forming the image layer. Here, since the image layer is formed after the base layer is formed, the base layer nozzle group G1 and the image layer nozzle group G2 have the relationship described below. Specifically, these are divided into the upstream nozzle group for which the nozzle group is positioned upstream in the sub-scan direction, and the downstream nozzle group for which the nozzle group is positioned further downstream than the upstream nozzle group. Then, the upstream nozzle group is used as the base layer nozzle group G1, and the downstream nozzle group is used as the image layer nozzle group G2. More specifically, the base layer nozzle group G1 uses the metallic ink nozzle groups positioned first through tenth from upstream, and the image layer nozzle group G2 uses each color nozzle group positioned eleventh to twentieth from upstream.

As noted above, by using the upstream nozzle group positioned upstream as the base layer nozzle group G1, and the downstream nozzle group positioned further downstream than the upstream nozzle group as the image layer nozzle group G2, it is possible to form the image layer after forming the base layer while transporting the printing medium from upstream to downstream.

When executing the second printing mode, printing is performed in sequence on the printing medium P with ink affixed in the sequence of metallic ink for image layer formation and colored ink for image layer formation. Also, when executing the second printing mode, there is no dividing into upstream and downstream nozzle groups, and printing is performed using all the nozzle groups. Specifically, printing is performed using the nozzles within the field enclosed by the dot-dash line of FIG. 5.

A piezo element is incorporated in each of the nozzles shown in FIG. 5. Piezo elements are elements in which the crystal structure deforms when voltage is applied, thereby converting electrical energy to mechanical energy at extremely high speed. In this embodiment, by applying a specified voltage signal (drive signal) to a piezo element, the wall on one side of an ink passage in the nozzle is deformed, so that ink droplets are discharged from the nozzle. In this embodiment, ink is discharged using piezo elements, but a method can be adopted in which ink is discharged by generating bubbles in the nozzles.

The drying mechanism 252 is equipped with nozzle groups 252V which are arranged aligned in the sub-scan direction and flow air. The nozzle groups 252V are longer than the length of each color ink nozzle group in the sub-scan direction. Also, the drying mechanism 252 has a heating part (e.g. electrically heated wires) for heating the air internally. As a result, heated air is blown toward the printing medium from the nozzle group 252V, which accelerates the drying of the ink affixed to the printing medium.

Control of the printing head 250 and the drying mechanism 252 described above is carried out by the control circuit 260 of the printer 200 shown in FIG. 4. The control circuit 260 has a configuration in which a CPU, ROM, RAM, PIF (peripheral device interface) and the like are interconnected by a bus, and control of primary scanning and sub-scanning operations of the carriage 240 is carried out by controlling the operation of the carriage motor 230 and the paper feed motor 235. In addition, when the printing data that has been output by the computer 100 is received via the PIF and the carriage 240 moves forward in the primary scan direction or moves backward in the primary scan direction, discharge of ink is controlled by supplying drive signals to the heads formed by the nozzle groups 244 to 249 in accordance with the printing data, thereby printing the prescribed raster. When forward or backwards movement accompanying ink discharge is completed in the primary scan direction of the printing medium P, the control circuit 260 transports the printing medium P in the sub-scan direction, thereby preparing for printing the subsequent raster. By repeating this operation, the printer 200 completes printing in each printing mode (first printing mode, second printing mode).

The printer 200 in this embodiment was described as a so-called ink jet printer that forms ink dots by discharging ink droplets towards the printing medium P, but this can also be a printer that affixes ink to a printing medium using another technique. For example, instead of a printer that discharges ink droplets, it could be one that uses static electricity to affix ink by attaching toner powder of each color on the printing medium, or it could be embodied as a thermal transfer printer or a sublimation type printer. In this embodiment, the concept of the ink includes toner powder as well as ink droplets.

A-4. Print Processing

Figure 6:
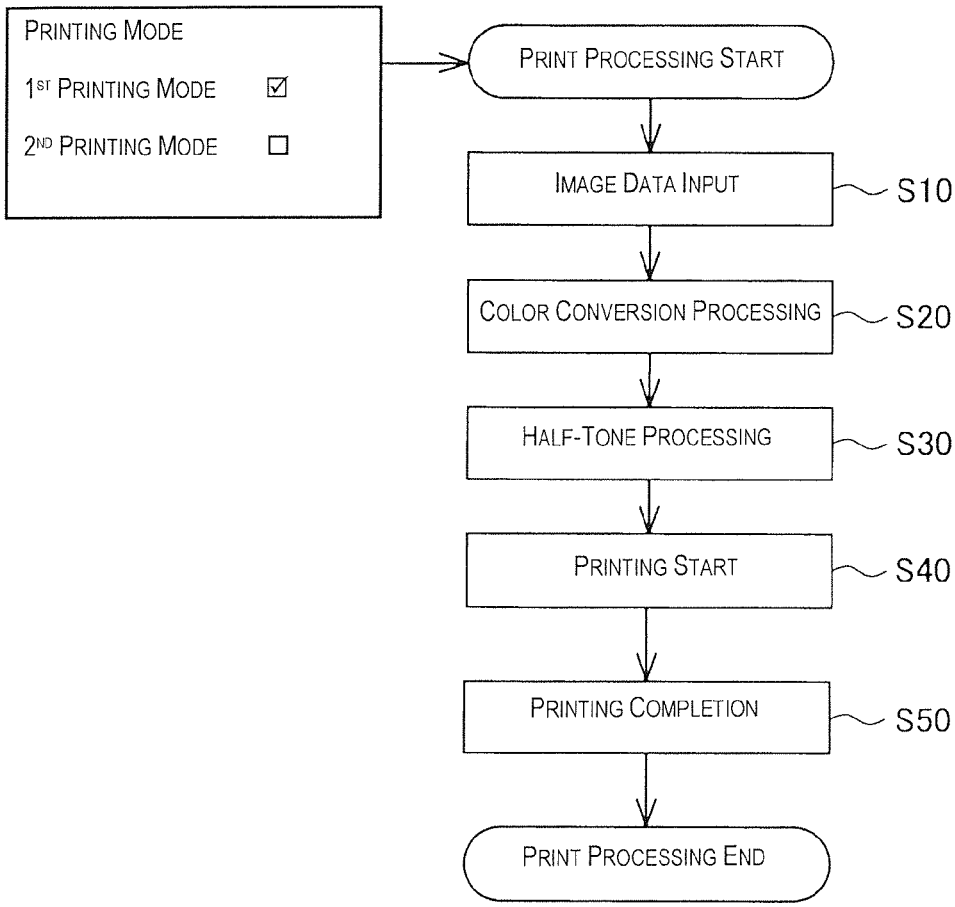
FIG. 6 is a flow chart showing the sequence of the print processing performed by the printing system 10.

Print processing that is carried out by the printing system 10 is described below. FIG. 6 is a flow chart showing the sequence of print processing performed by the printing system 10. Prior to initiation of print processing, the user uses the print setting screen that displays the application program 20 on the display 114 (FIG. 1) to enter print settings. As print settings, the user specifies the printing mode, and specifies the image layer metallic field in the image data ORG.

When print processing is initiated, image data to which data relating to specification of each field such as the image layer metallic field and specification of the printing mode has been added is input to the printer driver 24 (step S10). Next, the color conversion module 42 performs color conversion processing on the image data input to the printer driver 24 (step S20). In specific terms, the color conversion module 42 converts to CMYK format image data based on the RGB components included in the image data (step S20). When CMYK format image data is obtained, the half-tone module 44 performs half-tone processing on the CMYK format image data (step S30). Here, the half-tone module 44 carries out half-tone processing on the metallic ink in addition to the colored ink. More specifically, the half-tone module 44 carries out half-tone processing so that the ink volume of the metallic ink forming the base layer is 10%, and the ink volume of the metallic ink forming the image layer is 20%. Also, in the second printing mode, the half-tone module 44 performs half-tone processing so that the ink volume of the metallic ink forming the image layer is 30%.

Upon completion of half-tone processing, the printing control module 46 controls the printer 200 to start printing (step S40). When printing is started, ink is discharged from each of the nozzles of the printing head 250, and air is blown from the nozzle group 252V onto the printing medium. Here, when printing is started, the printer 200 performs the process of forming dots of each ink. The process of forming dots of each ink is performed in accordance with the set printing mode, and is performed over the entire range for which the image is formed on the printing medium.

Figure 7:
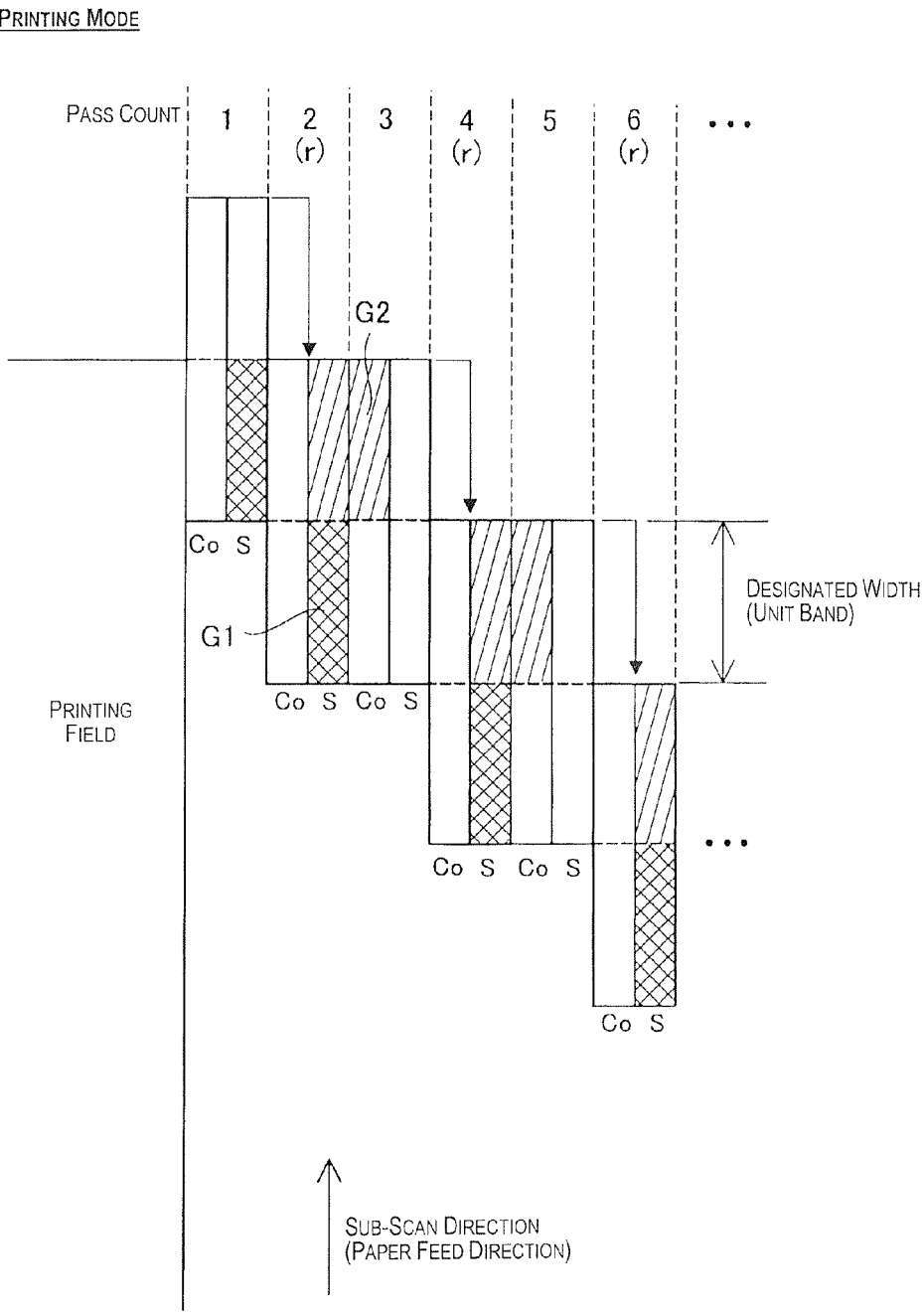
FIG. 7 is a diagram for illustrating an example of the printing operation in the first printing mode.
Figure 8:
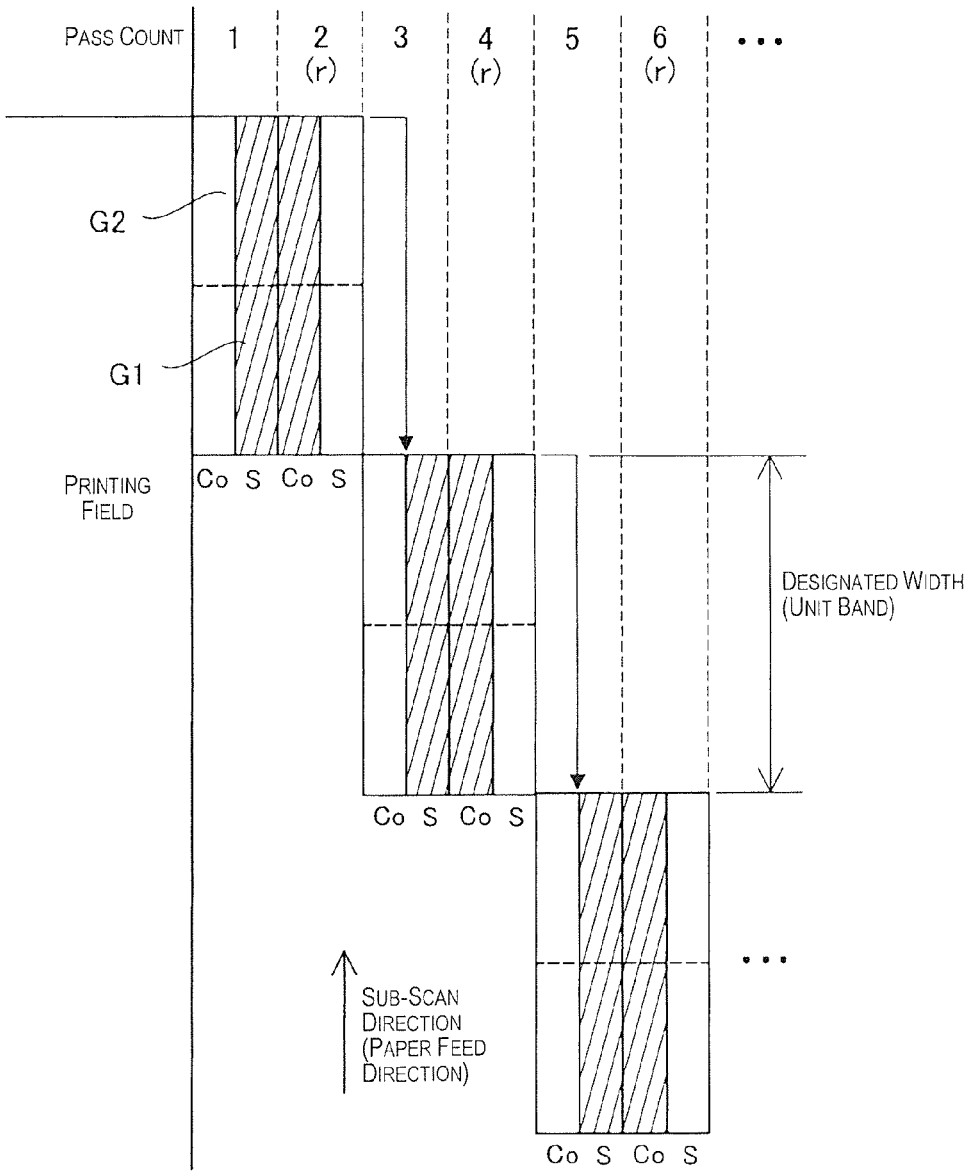
FIG. 8 is a diagram for illustrating an example of the printing operation in the second printing mode.

FIG. 7 is a drawing illustrating an example of the printing operation using the first printing mode. FIG. 8 is a drawing illustrating an example of the printing operation using the second printing mode. Here, FIG. 7 and FIG. 8 show the positions along the sub-scan direction of the nozzle groups used with each pass. Note that in FIG. 7 and FIG. 8, the nozzle groups are expressed as moving, but in actuality, by transporting the printing paper in the sub-scan direction, the nozzle groups are moving relative to the printing medium.

The "passes" noted in FIG. 7 and FIG. 8 mean the operation of moving the printing head 250 the nozzle group is equipped with (FIG. 4) in the forward direction or reverse direction in the primary scanning direction. The pass given the code "r" for the pass count in FIG. 7 and FIG. 8 is the pass that moves the printing head 250 in the reverse direction, and the other pass is the pass that moves the printing head in the forward direction. The forward direction is the direction facing near the other end from a preset home position near one end of the movement path of the carriage 240, and the reverse direction is the direction opposite to the forward direction. Also, the nozzle groups given the code "Co" in FIG. 7 and FIG. 8 are nozzle groups for discharging colored ink, and the nozzle groups given the code "S" are the nozzle groups for discharging metallic ink. Furthermore, of the nozzle groups, the fields marked by cross hatching or single hatching are the nozzle groups actually used to discharge ink. In FIG. 7, the nozzle groups of the fields marked by cross hatching are the base layer nozzle groups G1, and the nozzle groups of the fields marked by single hatching are the image layer nozzle groups G2 (FIG. 5).

When printing is performed in the first printing mode, as shown in FIG. 7, with the third pass, a designated width base layer and image layer are formed along the sub-scan direction. This designated width printing field is also referred to as a "unit band." Also, when printing for the unit band is competed, the transport operation of half the nozzle group length (paper feeding operation) is performed. For the image layer, first, an image layer is formed using the metallic ink with the first pass, and an image layer using the colored ink is formed with the next pass. Note that with each pass, when there is no dot data indicating that metallic ink or colored ink should be discharged, ink is not discharged from nozzles for which there is no dot data. Thus, the image layer is formed after formation of the base layer for each unit band, and when printing for all the printing fields is performed, printing is completed. Note that air is blown by the drying mechanism 252 onto the printing medium P from the nozzle group 252V during the back and forth operation of the carriage 240.

When printing is performed in the second printing mode, as shown in FIG. 8, the image layer of a designated width field is formed along the sub-scan direction with the second pass. More specifically, an image using metallic ink is formed with the first pass, and an image layer using colored ink is formed with the next pass. When printing of the unit band is completed, a transport operation of the length of the nozzle group (paper feeding operation) is performed. Note that with each pass, when there is no dot data indicating that metallic ink or colored ink should be discharged, ink is not discharged from nozzles for which dot data does not exist. Thus, with the second printing mode, since there are many nozzle groups for forming image layers (the number of nozzles in the sub-scan direction), it is possible to increase the printing speed more than with the first printing mode.

Figure 9A:
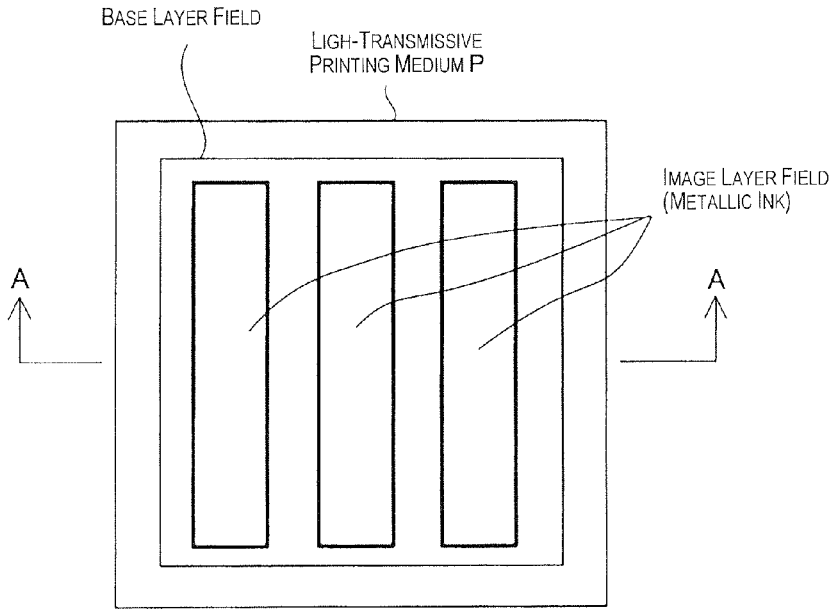
FIG. 9 is a diagram for illustrating an example of the printing operation in the first printing mode.
Figure 9B:
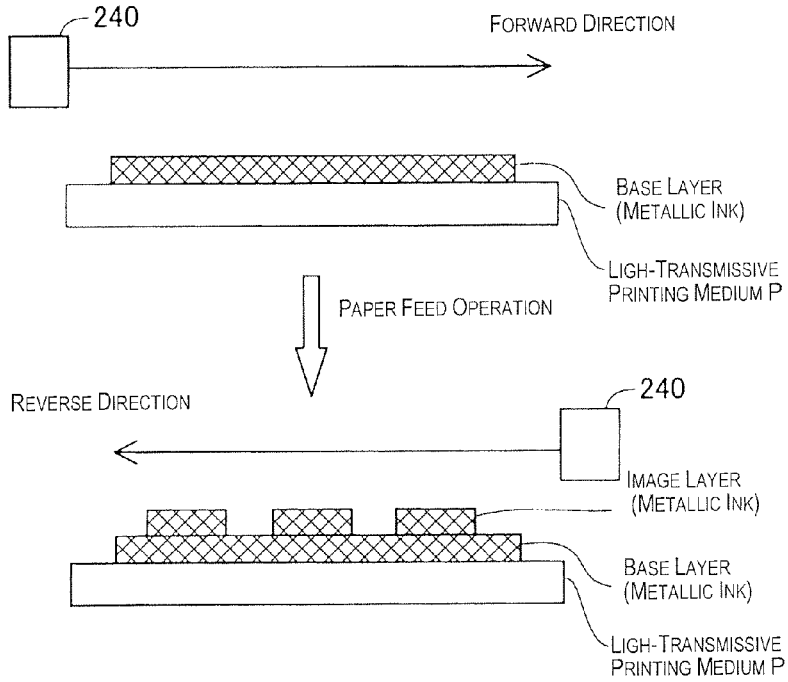

FIG. 9 is a drawing further illustrating an example of the printing operation with the first printing mode. FIG. 9A is a view of the light-transmissive printing medium P to which ink is affixed seen from the printing surface. FIG. 9B is a sectional view of A-A in FIG. 9A.

FIG. 9A is a diagram with a vertical pattern formed using metallic ink on the light-transmissive printing medium P. As shown in FIG. 9B, the base layer in the A-A cross section is formed by the forward direction operation of the carriage 240. Next, the paper feed operation is performed, and an image layer consisting of metallic ink is formed by the reverse direction operation of the carriage 240. When further forming an image layer consisting of colored ink, the carriage 240 is operated in the forward direction without performing the paper feed operation and colored ink is affixed to the light-transmissive printing medium P. Thus, the base layer, the image layer consisting of metallic ink, and the image layer consisting of colored ink are formed.

As noted above, with the first printing mode, the printer 200 of this embodiment forms the base layer using metallic ink, after which it forms an image layer containing metallic ink. As a result, since it is possible to form the image layer after the base layer is dried and fixed on the printing medium, it is possible to reduce the possibility of blurring of the image formed on the printing medium.

A-5. Reference Example

Figure 10:
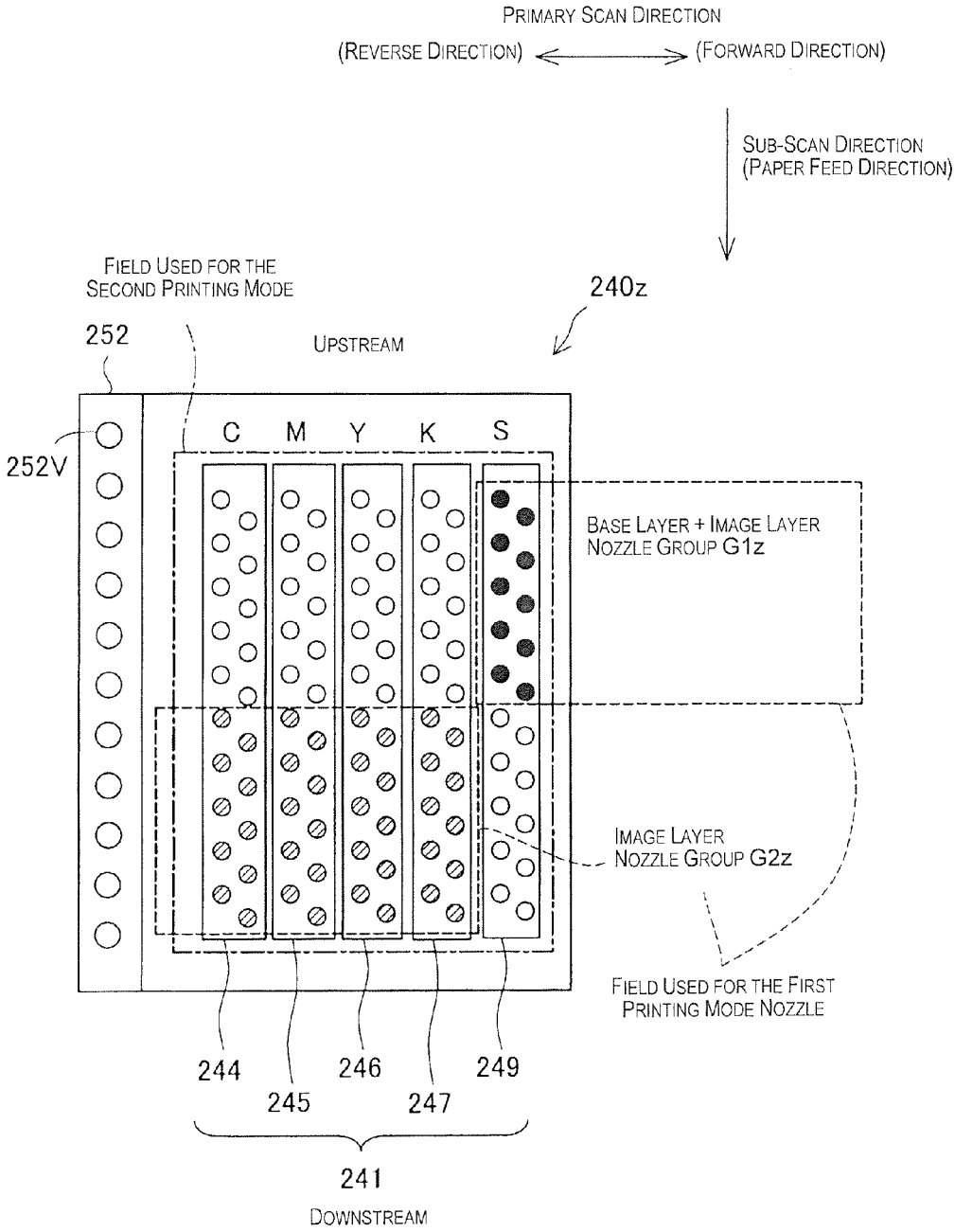
FIG. 10 is a schematic diagram of a nozzle forming surface in a reference example.

FIG. 10 is a schematic diagram of the nozzle forming surface with the reference example. The difference between the carriage 240 of the embodiment and the carriage 240*z* of the reference example is the position of the nozzles used for the first printing mode. The remainder of the configuration (nozzle arrangement and drying mechanism 252) are the same configuration as that of the embodiment, so hereafter the description will mainly be regarding the difference points from the embodiment.

With the reference example, of the metallic ink unit nozzle groups, the upstream nozzle group G1*z* positioned upstream in the sub-scan direction is used to form the base layer and the image layer. Meanwhile, of the metallic ink unit nozzle groups, the downstream nozzle group positioned further downstream than the upstream nozzle group G1*z* is not used. Also, of each color unit nozzle group of the colored inks, the downstream nozzle group G2*z* positioned further downstream than the upstream nozzle group G1*z* in the sub-scan direction is used to form the image layer.

Figure 11A:
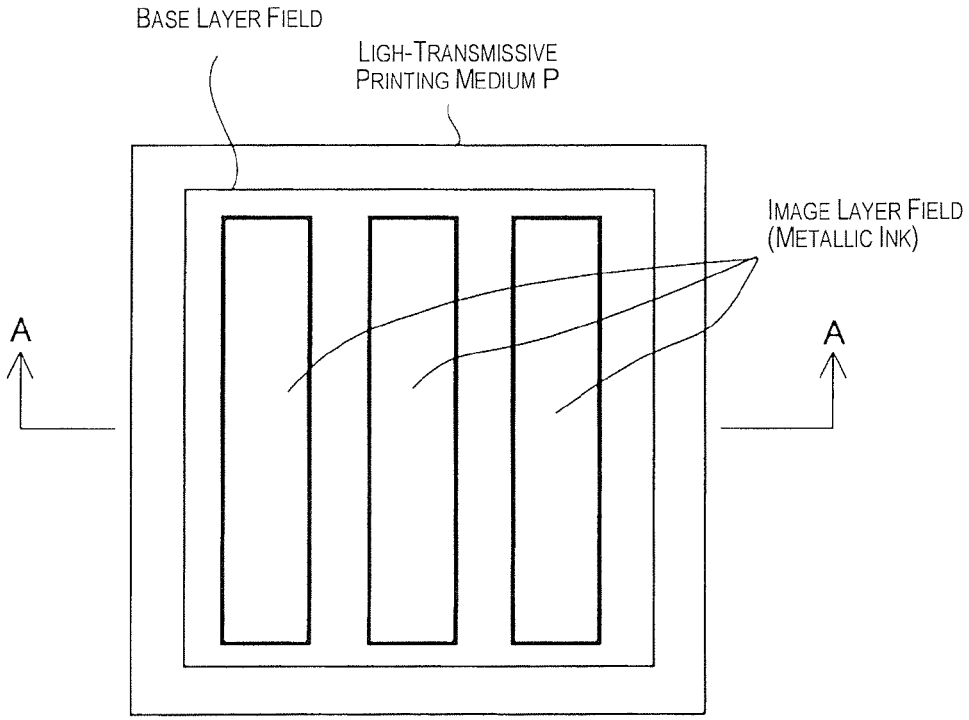
FIG. 11 is a diagram for illustrating the printing operation in the first printing mode of a reference example.
Figure 11B:
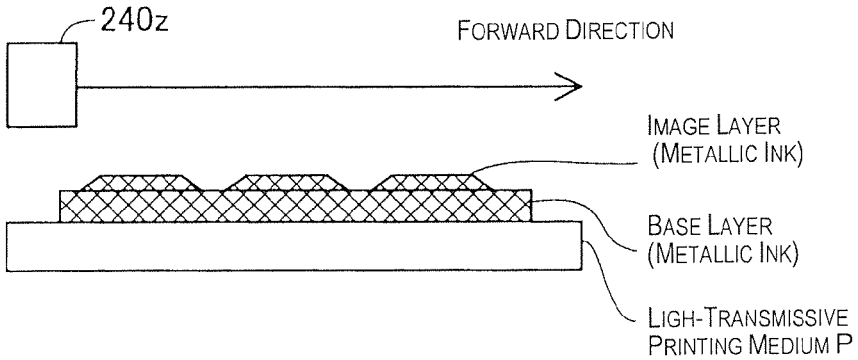

FIG. 11 is a diagram for illustrating an example of the printing operation using the first printing mode of the reference example. FIG. 11A is a view of the light-transmissive printing medium P to which ink is affixed seen from the printing surface. Also, FIG. 11B is a sectional view of A-A in FIG. 11A.

FIG. 11A, the same as with FIG. 9A, is a diagram for which a vertical pattern is formed by metallic ink on a light-transmissive printing medium P. As shown in FIG. 11B, the A-A cross section base layer and image layer are formed by the forward direction operation of the carriage 240*z*. Specifically, the base layer and the image layer are formed using metallic ink with the first pass. Note that when also forming an image layer consisting of colored ink, an image layer consisting of colored ink is formed by performing the paper feed operation and discharging colored ink from the image layer nozzle group G2*z*.

Thus, the base layer and image layer consisting of metallic ink are formed concurrently with the first pass with the reference example. Because of this, the image layer is formed before the metallic ink of the base layer has dried sufficiently. Thus, the metallic ink for forming the image layer flows, and the contour of the image (pattern) becomes blurry.

As noted above, with the first embodiment, when executing printing with the first printing mode, after forming the base layer by affixing metallic ink on the printing medium with the unit band, an image layer representing an image is formed using metallic ink and colored ink (FIGS. 8, 9). With the unit band, the pass with which the base layer is formed is different from the pass with which the image layer is formed. Thus, since the image layer is formed on the base layer after drying has progressed and it is fixed on the printing medium, it is possible to inhibit the flow of ink that forms the image layer. As a result, it is possible to reduce the possibility of blurring of the image formed on the printing medium.

Also, when executing printing using the first printing mode, the upstream nozzle group positioned upstream in the sub-scan direction is used as the base layer nozzle group G1, and the downstream nozzle group positioned further downstream than the base layer nozzle group G1 is used as the image layer nozzle group G2 (FIG. 5). As a result, by transferring the printing medium from upstream to downstream without reverse transport, it is possible to form the image layer after forming the base layer (FIGS. 7, 9). Thus, it is possible to further simplify the control of the printing system 10. Also, since reverse transport of the printing medium is not required, it is possible to form ink dots at precise positions, making it possible to make the printed image clearer.

Also, with the first embodiment, the nozzle groups used are different with the first printing mode and the second printing mode. More specifically, with the second mode, printing is performed using all the nozzles without dividing into the downstream nozzle group and the upstream nozzle group (FIG. 5). As a result, it is possible to improve the printing speed with the second printing mode.

Also, the printer 200 of the first embodiment is equipped with a drying mechanism 252, so it is possible to accelerate the drying of the ink affixed to the printing medium. Thus, for example when metallic ink is affixed on the printing medium to form the base layer in the first printing mode, it is possible to further accelerate the drying of the affixed metallic ink. Thus, it is possible to form the image layer on a base layer for which the fixing on the printing medium has been further accelerated, so it is possible to further inhibit the flow of ink that forms the image layer, and to further reduce the possibility of blurring of the image layer.

Also, with the first embodiment, metallic ink is used for the special glossy ink. Thus, it is possible to give the printing medium light shielding properties and also to give the printing medium a metallic glossy appearance.

B. Second Embodiment

Figure 12:
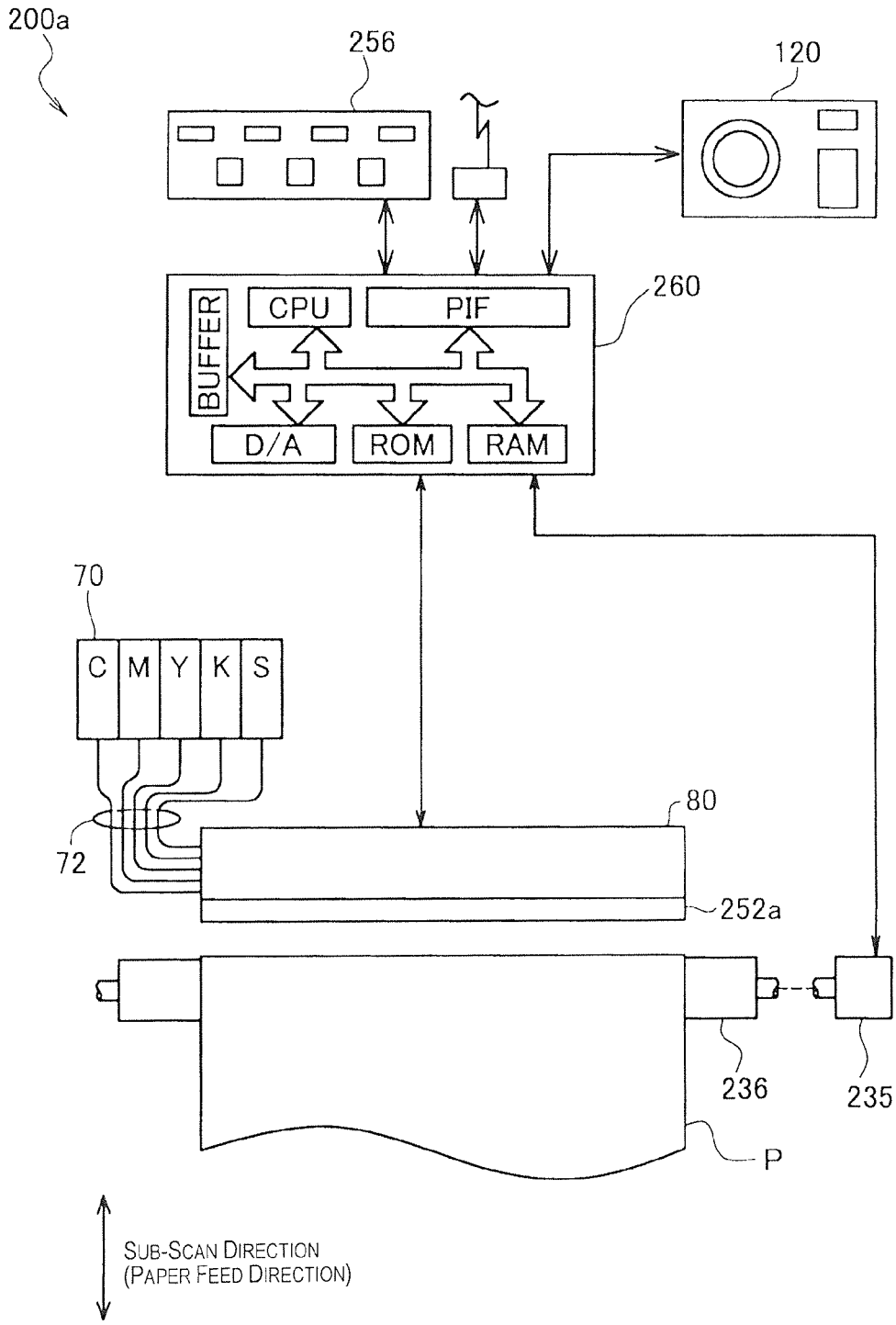
FIG. 12 is a diagram for illustrating the printer 200*a* of the second embodiment.

FIG. 12 is a diagram for illustrating the printer 200*a* of the second embodiment. FIG. 12 is a diagram correlating to FIG. 4 of the first embodiment. The point of difference from the printer 200 of the first embodiment is that the printer 200 of the first embodiment was a serial printer, while the second embodiment uses a line printer which does not involve back and forth movement of the carriage. The remainder of the configuration is the same as that of the first embodiment, so the same code numbers are given for the same configuration [components], and an explanation of those are omitted.

The printer 200*a* is equipped with a line head 80 capable of discharging ink across the width direction of the printing medium P, the drying mechanism 252*a*, the ink cartridges 70 which respectively house five colors of colored ink, an ink supply tube 72 for supplying ink from the ink cartridge to the line head 80, a paper feed motor 235, and a control circuit 260. This printer 200*a* performs printing by transferring the printing medium in the sub-scan direction.

Figure 13:
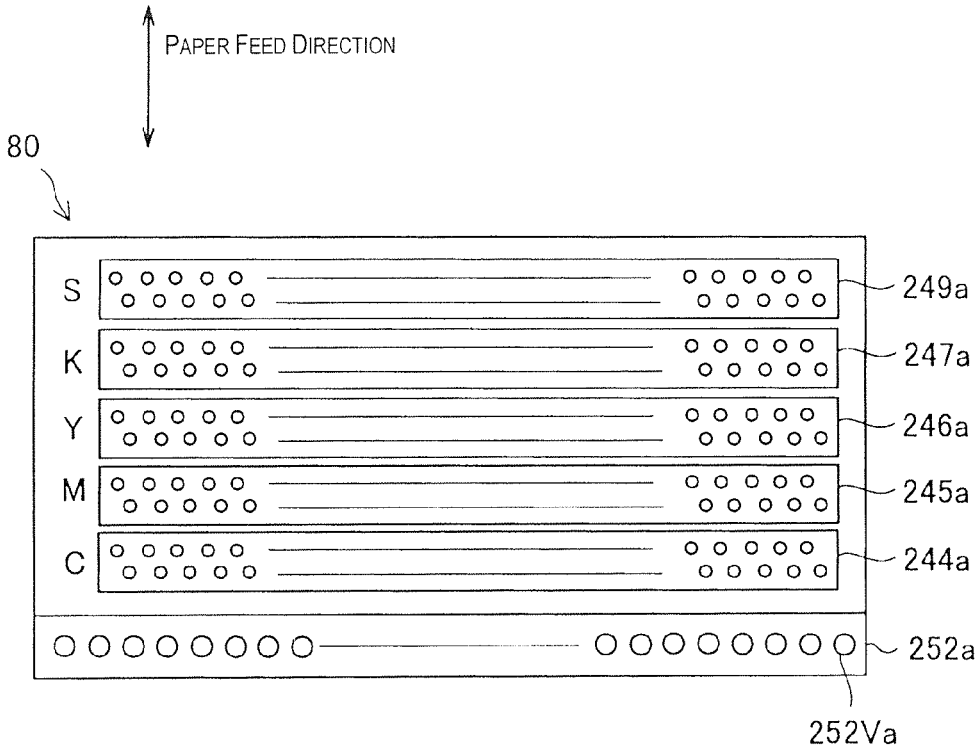
FIG. 13 is a schematic diagram of the line head 80 and the drying mechanism 252*a*.

FIG. 13 is a schematic diagram of the surface facing opposite the printing medium P (nozzle forming surface) of the line head 80 and the drying mechanism 252*a*. The nozzle groups 244*a* to 249*a* that discharge each color of ink are formed on the line head 80. Note that the 2,560 nozzles are provided respectively on each color nozzle group 244*a* to 249*a* of the metallic ink (S), the cyan ink (C), the magenta ink (M), the yellow ink (Y), and the black ink (K), but in FIG. 13, for purposes of illustration, 20 nozzles are noted for each color. Note, however, that the number of nozzles of each color is determined according to the specifications of the printer 200*a*. The nozzle groups that discharge the ink of each color are arranged in zigzag form (alternating) along the width direction of the printing medium P.

The same as with the first embodiment, piezo elements are incorporated within the nozzles that discharge each color of ink, and the inner wall of the ink path within the nozzle is deformed by the piezo elements, so that ink droplets are discharged from the nozzles.

The drying mechanism 252*a* is equipped with nozzle groups 252V*a* that are arranged along the width direction of the printing medium P and flow air. The nozzle groups 252V*a* are longer than the length of the nozzle groups for each color ink in the width direction of the printing medium P. Also, the drying mechanism 252*a* has a heating part the same as with the first embodiment, and heated air is blown from the nozzle group 252V*a* onto the printing medium P.

Figure 14A:
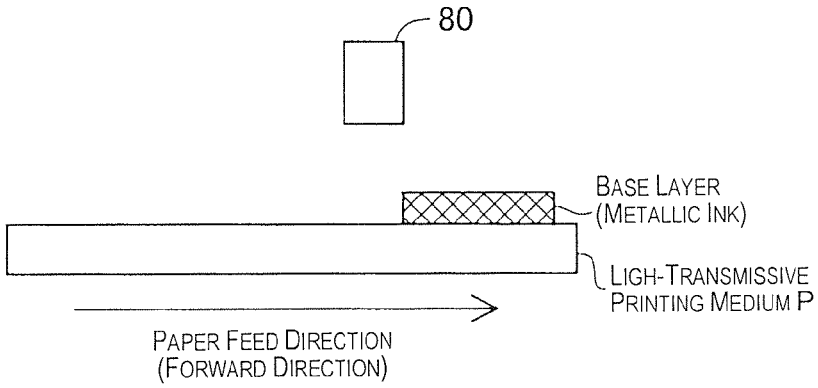
FIG. 14 is a diagram for illustrating an example of the printing operation in the first printing mode.
Figure 14B:
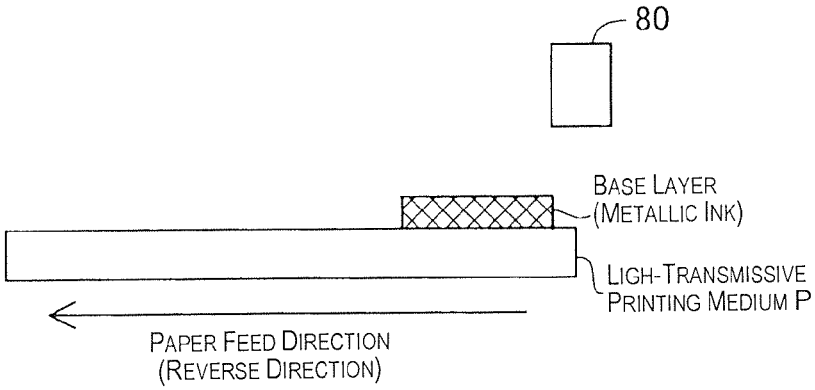
Figure 14C:
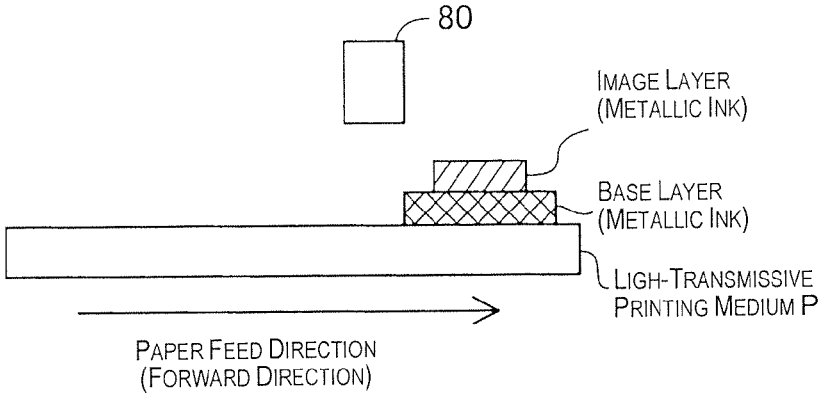

FIG. 14 is a diagram for illustrating an example of the printing operation using the first printing mode. FIG. 14 A to C schematically show the operation when performing printing on a designated field. With the cross section in FIG. 14, an image layer consisting of metallic ink is formed on the base layer consisting of metallic ink. As shown in FIG. 14A, the printer 200*a* affixes metallic ink to the designated field while transferring the light-transmissive printing medium P in the forward direction to form the base layer. Next, as shown in FIG. 14B, the light-transmissive printing medium P is transferred in the reverse direction so that the line head 80 is positioned at the head position of the designated field. Then, as shown in FIG. 14C, the printer 200*a* affixes the metallic ink while transferring the light-transmissive printing medium P in the forward direction to form the image layer. Also, while the printing operation is being started, heated air is blown on the light-transmissive printing medium P by the drying mechanism 252*a*. Note that when an image layer consisting of colored ink is formed, colored ink is affixed on the metallic ink image layer or base layer. When the operations of the FIG. 14A to C noted above are performed on all the printing fields of the light-transmissive printing medium P, printing is completed. Note that when performing printing in the second printing mode, while transferring the printing medium in the forward direction, the metallic ink and colored ink are affixed in that sequence on the same field of the printing medium.

As noted above, the same as with the first embodiment, with the second embodiment, when executing printing in the first printing mode, after affixing metallic ink on the printing medium to form a base layer, metallic ink and colored ink are used to form an image layer representing an image (FIG. 14). Thus, since the image layer is formed on a base layer after drying has proceeded and fixing on the printing medium is accelerated, it is possible to inhibit the flow of ink that forms the image layer. As a result, it is possible to reduce the possibility of the image formed on the printing medium being blurred. Also, since the printer 200*a* of the second embodiment is equipped with a drying mechanism 252*a*, the same as with the first embodiment, it is possible to further accelerate drying of the ink affixed on the printing medium, making it possible to further reduce the possibility of the printed image being blurred.

C. Modification Examples

Note that among the constitutional elements of the embodiments noted above, the elements other than the elements noted in the independent claims are additional elements, and can be omitted as appropriate. Also, the invention is not limited to these embodiments and modes, and various configurations can be adopted that do not deviate from the scope of the invention. For example, the following types of modifications are possible.

C-1. First Modification Example

In the above embodiments, metallic ink was used as the special glossy ink, but the ink is not limited thereto, and various special glossy inks can be used. For example, it is possible to use pearlescent inks containing a pigment in which thin film layers having a pearl color are multiply layered, as with natural pearl, or lame inks or lacquered inks containing a pigment having fine non-uniformities that manifest a so-called lame or lacquered appearance by scattered reflection when affixed to the surface of a printing medium. In the embodiments described above, pigment-based inks were used as the colored inks, but dye-based inks can also be used.

C-2. Second Modification Example

In the above embodiments, the drying mechanism 252 and 252*a* were used as the mechanism for blowing heated air on the printing medium, but the mechanism is not limited thereto, and various types of mechanisms can be used as long as they are able to accelerate the drying of the ink affixed on the printing medium. For example, when using an ink that cures when irradiated with ultraviolet rays as the ink for forming the base layer and the image layer, a mechanism for irradiating ultraviolet rays on the printing medium can be used. It is also possible to use a drying mechanism which is a mechanism that simply blows air on the printing medium without providing a heating part such as electrically heated wires or the like.

C-3. Third Modification Example

In the above embodiments, in a field for which the base layer formed by affixing metallic ink which is a special ink and the image layer formed by affixing metallic ink and colored inks which are inks other than metallic ink (image layer of the image layer overlapping field) are formed overlapping, the times can be set freely for the time T1 from when the metallic ink is affixed to form the base layer until the metallic ink is affixed to form the image layer, and the time T2 from when the metallic ink is affixed to form the image layer until the colored ink is affixed to form the image layer. Here, it is preferable that the time T1 be set longer than the time t2, and that the printer driver 24 which is the controller execute printing. By making the time T1 longer than the time T2, compared to when the time T1 and the time T2 are the same, it is possible to accelerate drying of the base layer metallic ink. As a result, it is possible to reduce the possibility of the image layer formed on the base layer being blurred. In particular, when the ink volume of the metallic ink affixed as the base layer is greater than the ink volume of the metallic ink affixed as the image layer, it is preferable that the time T1 be set to be longer than the time T2. By doing this, it is possible to ensure drying time for the base layer metallic ink for which a greater volume of ink was affixed. Thus, it is possible to reduce the possibility of the image layer on the base layer being blurred. Note that adjustment of the times T1 and T2 can be realized with a serial printer for example by changing the back and forth movement speed of the carriage 240, and can be realized with a line printer for example by changing the transport speed of the printing medium.

C-4. Fourth Modification Example

In the above embodiments, in a first case of printing an image on a printing medium without forming a base layer (e.g. second printing mode, FIG. 2B), in the field in which the image layer is formed by affixing metallic ink which is a special glossy ink and colored ink which is an ink other than a metallic ink (the image layer overlapping field), it is possible to freely set the time T3 from when the metallic ink to form the image layer is affixed until the colored ink to form the image layer is affixed. Also, with the above embodiments, in a second case of printing an image on a printing medium after the base layer is formed (e.g. first printing mode, FIG. 2A), it is possible to freely set the time T4 from affixing the metallic ink to form the base layer unit until affixing the metallic ink to form the image layer. Here, it is preferable that printing be controlled so that the time T3 is longer than the time T4. By doing this, when an image layer is formed on a printing medium for which a base layer is not formed, it is possible to ensure a long time until the metallic ink for forming the image layer is affixed on the base layer. As a result, it is possible to accelerate drying of the metallic ink affixed on the printing medium for forming the base layer. In particular, as described in the embodiments noted above, with the first and second printing modes, when the ink volume of the metallic ink used for printing is the same (e.g. ink volume 30%), it is preferable that the time T3 be longer than the time T4. As a result, when a larger volume of metallic ink is affixed for image formation, by making the time T3 longer, it is possible to affix the colored ink on the metallic ink after more surely drying the metallic ink of the image layer. Note that adjustment of the times T3 and T4 can be realized with a serial printer for example by changing the back and forth movement speed of the carriage 240, and with a line printer for example by changing the transport speed of the printing medium.

The entire disclosure of Japanese Patent Application No. 2011-126845, filed Jun. 7, 2011, is expressly incorporated by reference herein.

What is claimed is:

1. A printing device for printing an image on a printing medium, comprising:

an affixing part for affixing on a printing medium ink containing special glossy ink whose optical characteristics depend on the reflection angle, and a controller for controlling the operation of the printing device, the controller forming the base layer by affixing the special glossy ink on the printing medium using the affixing part, the controller forming, after forming the base layer, the image layer representing the image on the base layer, the image layer containing the special glossy ink and an ink other than the special glossy ink.

2. The printing device according to claim 1, wherein the affixing part is a nozzle group that moves in the primary scan direction, and that discharges the ink toward the printing medium, and is a nozzle group for which unit nozzle groups which are collections of nozzles arranged aligned in the sub-scan direction formed for each ink color are aligned in the primary scan direction, the nozzle group including an upstream nozzle group arranged upstream in the sub-scan direction and that discharges the special glossy ink, and a downstream nozzle group arranged downstream in the sub-scan direction and that discharges the ink containing the special glossy ink.

3. The printing device according to claim 1, wherein the ink further includes colored ink for forming the image layer.

4. The printing device according to claim 3, wherein the printing device is configured to perform printing using either a first printing mode which forms the image layer using the special glossy ink on the base layer after forming the base layer using the special glossy ink, or a second printing mode which forms the image layer using the ink on the printing medium without forming the base layer, the controller forming the base layer using the upstream nozzle group, and forming the image layer using the downstream nozzle group with the first printing mode, and the controller forming the image layer using a nozzle group including the upstream nozzle group and the downstream nozzle group with the second printing mode.

5. The printing device according to claim 1, wherein the special glossy ink is metallic ink.

6. The printing device according to claim 1, further comprising a drying mechanism for drying the base layer formed on the printing medium.

7. The printing device according to claim 1, wherein in the field on which are formed the base layer by the special glossy ink and the image layer by the special glossy ink and inks other than the special glossy ink, the time between affixing of the special glossy ink for forming the base layer and affixing of the special glossy ink for forming the image layer is longer than the time between affixing of the special glossy ink for forming the image layer and affixing of the inks other than the special glossy ink for forming the image layer.

8. The printing device according to claim 1, wherein on a printing medium for which the base layer formation is not performed, in the field on which the image layer is formed by the special glossy ink and inks other than the special glossy ink, the time between affixing of the special glossy ink for forming the image layer and affixing of inks other than the special glossy ink for forming the image layer is longer than, on a printing medium for which the base layer formation is performed, in the field on which the image layer is formed by the special glossy ink and inks other than the special glossy ink, the time between affixing of the special glossy ink for forming the image layer and affixing of inks other than the special glossy ink to form the image layer.

9. A printing method for which a printing device prints an image on a printing medium, comprising:

forming a base layer by affixing on the printing medium a special glossy ink whose optical characteristics depend on the reflection angle, and after forming the base layer, forming an image layer representing the image on the base layer, the image layer containing the special glossy ink and an ink other than the special glossy ink.

10. A non-transitory computer-readable medium on which is recorded a computer program for forming images using a printing device, the computer program realizing on a computer:

a function of forming a base layer by controlling an affixing part for affixing ink on a printing medium, and affixing on the printing medium a special glossy ink whose optical characteristics depend on the reflection angle, and a function of forming an image layer representing an image on the base layer by, after the base layer is formed, controlling the affixing part, the image layer containing the special glossy ink and an ink other than the special glossy ink.

* * * * *